US005407597A

United States Patent [19]

Busch et al.

[11] Patent Number: 5,407,597

[45] Date of Patent: Apr. 18, 1995

[54] GALVANIZED METAL CORROSION INHIBITOR

[75] Inventors: Bruce D. Busch, Shakopee; Michael Oldsberg, Chaska, both of Minn.

[73] Assignee: Fremont Industries, Inc., Shakopee, Minn.

[21] Appl. No.: 231,269

[22] Filed: Apr. 22, 1994

[51] Int. Cl.[6] ..... C23F 11/16; C23F 11/167

[52] U.S. Cl. ..... 252/389.23; 252/389.22; 252/389.54; 252/395; 210/699; 210/700; 422/16; 422/15; 422/19

[58] Field of Search ..... 252/389.1, 389.22, 389.23, 252/180, 389.54, 395; 210/699, 700; 148/250, 253, 261; 422/15, 16, 19

[56] References Cited

U.S. PATENT DOCUMENTS 4,505,748 3/1985 Baxter ..... 148/250

*Primary Examiner*—Gary Geist
*Assistant Examiner*—Valerie Fee
*Attorney, Agent, or Firm*—Haugen and Nikolai

[57] ABSTRACT

A white rust inhibiting composition and method of inhibiting white rust for evaporative water coolers are disclosed. The composition includes in combination a blend of one or more organophosphorus compounds, one or more carbamate compounds, and one or more water soluble metal compounds.

21 Claims, No Drawings

GALVANIZED METAL CORROSION INHIBITOR

BACKGROUND OF THE INVENTION

I. Field of the Invention

The present invention relates generally to improved formulations for the treatment of open evaporative cooling water systems and more specifically to formulations advantageous in the prevention of corrosion of zinc based coating materials of such systems during their normal operation.

II. Related Art

Open evaporative cooling water circulation systems are commonly employed in large industrial or commercial installations requiring large amounts of cooling water. In the operation of evaporative systems utilizing cooling water, amounts of cooling water are continually being evaporatively lost to the atmosphere, creating a need for quantities of additional or make-up water which, as required, are introduced and utilized at a rate dependent upon the service requirements of the installation. As introduced, make-up water commonly contains amounts of impurities and/or contaminants including dissolved gases, dissolved chemical compounds and suspended particulates. Since normal operation of these systems results in the consumption of reasonably large quantities of water, primarily through evaporation, over time this results in elevated levels of concentration of these contaminants and/or impurities. Of particular concern is the accumulation of carbonate alkalinity and the associated increase in pH levels.

Zinc based coatings are commonly employed on steel surfaces of open evaporative cooling equipment in order to offer corrosion inhibiting protection of the ferrous metal substrate. The well-known galvanized coatings are an example of such zinc based sacrificial coatings.

The elevation of carbonate alkalinity and pH levels during the normal operation of cooling water systems often results in the corrosion of the zinc based coatings of those systems. The corrosion of these coatings visually appears as a white, waxy, adherent deposit on the coating surfaces. This corrosion mechanism or syndrome is commonly referred to as "White Rust" by persons in the water treatment industries. White rust has been identified as a corrosion mechanism involving zinc metal and carbonate ion and resulting in the formation of the compound $ZnCO_3.3Zn(OH)_2.H_2O$. White rust corrosion results in the loss of corrosion inhibition or protection of the ferrous metal substrate by the zinc coating and, if unchecked, may therefore lead to the premature failure of the cooling system equipment occasioned by the rapid anodic corrosion of zinc coated parts.

There are several current methods that have been employed or proposed for the prevention of white rust corrosion; they include the following techniques:

(a) The addition of sufficient quantity of an acid, most commonly sulfuric acid, to the cooling water in order to adjust the pH and prevent the presence or greatly reduce the concentration of carbonate ions in the cooling water has been suggested as a way to preclude the formation of zinc carbonate and thereby prevent or inhibit white rust corrosion. The addition of acid feed to cooling water systems, however, poses safety hazards to those personnel responsible for handling the acid and has the potential for aggressive corrosion of metals due to overfeed of acid to the system.

(b) Another approach suggests the addition of amounts of orthophosphate and/or zinc chemical compounds to the cooling water in order to provide a zinc-orthophosphate film capable of preventing white rust corrosion. Both the orthophosphate and zinc components are generally present in quantities of 20 to 100 mg/l as $PO_4$ and as Zn. The Phosphate and Zinc-Phosphate treatments are effective as short-term treatments to provide corrosion preventing or passivating films on metallic surfaces.

The effectiveness of this approach to protection is usually short-lived, however, and the film soon degrades. Degradation of the passivating film must be followed by re-passivation to prevent localized white rust corrosion. Moreover, since the production of these passivating films is also dependent upon many influencing parameters of the cooling equipment, water and water treatments utilized, the quality and longevity of the passivating films remain as uncertain variables and the systems must be continually monitored for film failure and white rust formation.

Additional disadvantages of such passivating treatments include the possible formation of deposits on heat transfer surfaces resulting in decreased equipment efficiency, potential regulatory concerns relative to the cooling water disposal, potential for damage to the passivated film by oxidizing biocide treatments, by over feed of acidic pH control chemicals and/or by physical erosion.

The use of hard make-up water (water containing hardness ions, i.e., calcium and magnesium ions) is recommended in conjunction with current film-forming methods of white rust control as many of the film-forming corrosion inhibitors utilized require the incorporation of calcium ions in those films. Calcium ions present in the cooling water may also compete with zinc coatings for the carbonate ions in the cooling water thereby reducing the formation of zinc carbonate.

The requirement for hard water feed to cooling systems is disadvantageous in those instances where the available make-up water contains little or no calcium ions as supplied as well as in those instances where cooling make-up water is preferably softened in order to prevent calcium carbonate scale formation on heat transfer surfaces.

It will be appreciated that a benign approach to the reduction of white rust corrosion in zinc-based coatings which circumvents known disadvantages of previous techniques would be a welcome solution to a longstanding problem associated with water cooling systems. This is especially true of a cooling water treatment that would be compatible with the existing water conditions (i.e., relatively high pH and alkalinity and relatively low hardness).

Accordingly, it is a primary object of the present invention to provide a cooling water treatment system including formulations which are capable of preventing or significantly reducing white rust corrosion of zinc coatings utilized in cooling system equipment thereby extending the useful life of that equipment.

Another object of the invention is to provide a cooling water treatment system capable of preventing or significantly reducing white rust corrosion of zinc-based coatings on components in open-evaporative cooling water systems which avoids the prior limitations.

A further object of the present invention is to provide formulations effective in the prevention of white rust corrosion of zinc coatings in cooling systems with elevated carbonate alkalinity and pH values thereby eliminating the need for neutralizing acid feed to the cooling tower water and therefore avoiding the associated potential disadvantages.

A still further object of the present invention is to provide formulations effective in the prevention of white rust corrosion of zinc coatings in cooling water systems employing soft water (water essentially void of calcium or magnesium ions).

Yet another object of the invention is to provide formulations effective in the prevention of white rust corrosion of zinc coatings in cooling systems which employ chemical compounds which themselves will not contribute to scale, deposit or corrosion of the cooling water system when those formulations are utilized at residuals necessary to provide effective white rust control.

A yet still further object of the present invention is to provide formulations effective in the prevention of white rust corrosion of zinc coatings which are compatible with other chemical treatments utilized in cooling water systems for purposes of scale, deposit, microbiological fouling or corrosion inhibition.

Other and further objects of the present invention will become apparent to those skilled in the art upon a study of the following specification and appended claims.

SUMMARY OF THE INVENTION

The present invention provides multi-component combinations or formulations which are capable of preventing or significantly reducing white rust corrosion of zinc-based coatings found on open evaporative cooling water systems which avoid the limitations and disadvantages associated with currently utilized technologies.

The formulations of the present invention may be fed to the cooling water system either as adjunct treatments utilized in combination with scale, deposition and corrosion inhibiting formulations or as "multi-purpose" systems comprising the ingredients described in the present invention together with ingredients intended for use as scale, deposition and corrosion inhibitors. They may be substantially dry and crystalline or as water solutions.

As the combinations of the present invention are compatible with typical cooling water pH levels and function without regard to the presence of hard ions, they may be used freely with other cooling water treatments as well as in the presence of impurities commonly present in cooling water. The materials of the present invention may be fed on a continuous basis thereby providing continuing re-passivation of zinc coating surfaces should the passive film provided by the present invention be impaired by any means. The water treatment formulae of the present invention employ a synergistic blend of one or more organophosphorus compounds with one or more carbamate compounds and one or more soluble metal compounds.

Organophosphorus compounds suitable for use in the present invention include compounds selected from a group including 1-hydroxyethylidene-1,1-diphosphonic acid; aminotris methylenephosphonic acid; 2-phosphonobutane-1,2,4-tricarboxylic acid; 1,2-diaminocyclohexane tetrakis-(methylene-phosphonic acid); 2-methylpentane diamine tetrakis-(methylene-phosphonic acid); Phosphono-hydroxyacetic acid and other organophosphorus compounds of comparable properties.

The carbamate compounds utilized in the present invention include compounds selected from sodium dimethyldithiocarbamate, sodium diethyldithiocarbamate, and other carbamate compounds exhibiting comparable properties.

The metal compounds utilized in the prevent invention include the water soluble salts of metals selected from molybdenum; titanium; tungsten and vanadium and others of similar properties.

DETAILED DESCRIPTION

The components of the combination of the invention are generally known individually to possess certain desirable properties applicable to aspects of cooling tower water treatment not relating to white rust prevention. In this manner, certain of the organophosphorus compounds employed alone have found favor in the treatment of open-evaporative cooling systems as scale and deposit preventatives and modifiers as well as corrosion inhibitors for ferrous metals. Some of the carbamate compounds have been shown to be useful in the precipitation of metal ions from effluent waters and as microbiocides in cooling water systems; and many of the soluble metal salts have been utilized as ferrous metal corrosion inhibitors in cooling systems.

The combined effect of the multi-component system of the invention has been discovered to be far more beneficial than could have been predicted. This will become apparent from the examples detailed below.

Experiments were performed utilizing a simulated cooling system test rig which enabled the control of pH, recirculation rate, water volume and water temperature parameters. The raw material ingredients as listed were tested alone and in combinations with each other at concentrations in the cooling water between 1 and 100 mg/l as active ingredient.

None of the ingredients listed when tested alone was found to effectively control white rust corrosion. A combination of ingredients, as presented in Example I below, were found to inhibit white rust corrosion on galvanized steel panels at greater than 95% inhibition in test rig conditions including hard and soft test waters with pH values held from 7.5 to 10.0.

EXAMPLE I

| Ingredient | Test Concentration in Cooling Water |
|---|---|
| Sodium molybdate, dihydrate ($Na_2Mo_4.2H_2O$) | 10 mg/l as Mo (1 part) |
| 2-phosphonobutane-1,2,4-tricarboxylic acid $C_7H_{11}O_9P$ 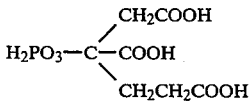 | 20 mg/l as active ingredient (2 parts) |
| Phosphono-hydroxyacetic acid ($C_2H_5O_6P$) 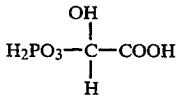 | 20 mg/l as active ingredient (2 parts) |

-continued

| Ingredient | Test Concentration in Cooling Water |
|---|---|
| Sodium diethyldithiocarbamate ($NaC_5H_{10}S_2N$) | 10 mg/l as active ingredient (1 part) |

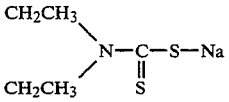

Table I, below, represents a tabulation of test data obtained with respect to white rust inhibition utilizing components of the combination of ingredients of Example I.

TABLE I

| Treatment Utilized | Concentration Employed (Active) | g/sq. ft./year Corrosion Rate | Galvanized Coating Failure (as % area Failed) |
|---|---|---|---|
| None (Control) | — | 304.2 | 59 |
| Sodium molybdate, dihydrate | 75 mg/l | 8.1 | 8 |
| 2-phosphonobutane-1,2,4-tricarboxylic acid | 75 mg/l | 33.5 | 28 |
| Phosphono-hydroxyacetic acid | 75 mg/l | 23.9 | 22 |
| Sodium diethyldithiocarbamate | 75 mg/l | 31.9 | 10 |
| Example I (COMBINATION) | 75 mg/l | 2.9 | 0 |

Test Conditions:

pH = 9.5 (maintained with sodium carbonate additions)
Cooling water temperature: 80° F.
Cooling water hardness level: 0 mg/l as total hardness
Test duration: 150 hours Preweighed, galvanized (G-90) panels were immersed in the cooling test rig employing the above test conditions. All panels tested were cleaned by the immersion in a solution of 30% ammonium hydroxide and 2% ammonium dichromate in distilled water in order to remove all white rust corrosion from the panels. All panels were re-weighed following cleaning. Weight loss of panels was recorded.

All test panels, with the exception of those panels treated with the combination formula described in Example I, revealed failure of the galvanized coating to the extent listed in Table I. This failure was visibly perceptible; a the loss of spangled galvanized coating and the revelation of the steel substrate, following the cleaning of the panels. Tests of these panels of greater durations were found to result in the continued failure of the galvanized costing until, ultimately, total galvanized coating failure was observed.

The test panels treated with the combination formula of Example I revealed no failure of the galvanized surface. Extended duration testing revealed only a negligible increase in weight loss as a function of time. The corrosion rate (as weight loss in grams/square foot/-year) of panels treated with the combination formula of Example I was, therefore, found to significantly decrease as the time duration of the tests increased. None of the extended duration test panels treated with the combination formula of Example I revealed failure of the galvanized coating. It is theorized that the relatively low (baseline) weight loss of those panels treated with Example is the result of the reaction of the combination formula of Example I with the galvanized coating of the panel in the formulation of an inhibitor film.

The data tabulated above clearly illustrates the dramatic effect of the ingredient combination represented by Example I with respect to the inhibition of white rust corrosion of G-90 galvanized steel panels subjected to simulated cooling water conditions.

In addition to the formulation of Example I, in order to best disclose the properties of typical preferred formulae, the following further specific examples of successful formulae are also provided:

EXAMPLE II

| Ingredient | Percent Active (by weight) | |
|---|---|---|
| Sodium molybdate, dihydrate ($Na_2Mo_4.2H_2O$) | 6.25% | (~2.5% Active Mo) |
| 2-phosphonobutane-1,2,4-tricarboxylic acid | 5.00% | |
| Phosphono-hydroxyacetic acid | 5.00% | |
| Sodium diethyldithiocarbamate | 2.50% | |
| Sodium hydroxide | 10.00% | |
| Water | Balance | |

The above formulation has been prepared in a stainless steel or glass lined vessel equipped with a cooling jacket. Water was added to the vessel and the cooling jacket was employed. Sodium molybdate, dihydrate was added to the vessel With agitation provided until the molybdate dissolved. Sodium hydroxide was then added to the vessel slowly, with agitation, taking care that the maximum temperature of the reactant mixture did not exceed 120° F. The 2-phosphonobutane-1,2,4-tricarboxylic acid, phosphonohydroxyacetic acid and sodium diethyldithiocarbamate ingredients were added slowly, with agitation in the order listed, again taking care not to exceed 120° F. maximum temperature.

The formula of Example II is illustrated as an aqueous solution but can be rendered in and used in a dry state as well. In this regard, the above listed percentage composition of the ingredients, of course, will change but the ratio of active ingredients should remain essentially the same, i.e., the ratio of the two organophosphorus compounds to the active Mo and carbamate should remain at about 2:1. The sodium hydroxide adjusts the pH of the formula to the desired alkalinity and may vary.

EXAMPLE III

| Ingredient | Percent Active (by weight) | |
|---|---|---|
| Sodium tungstate, dihydrate | 8.97% | (~5% active W) |
| 2-phosphonobutane-1,2,4-tricarboxylic acid | 5.00% | |
| Phosphono-hydroxyacetic acid | 5.00% | |
| Sodium diethyldithiocarbamate | 2.50% | |
| Sodium hydroxide | 10.00% | |
| Water | Balance | |

The above formulation is prepared in a manner similar to that described for Example II. The formulation of Example III, prepared as described, is a clear, amber solution with a pH of approximately 10.5.

The combination of Example III was found to effectively prevent white rust corrosion on galvanized steel panels which were tested in cooling waters ranging from 0 mg/l to 500 mg/l total hardness at pH values ranging from 7.5 to 10.0, when applied to the cooling water at a concentration of 100 to 500 mg/l as total product.

As was the case with the formulation of Example II, this formula can be dried in any well-known manner to a dry or crystalline form (5%–10% water) for storage, shipment and use in a dry bulk state. The range of composition values involves maintaining the approximate ratios with respect to active species.

While the above represent particularly successful presently proved combinations of the class discovered to be effective, such are presented by way of example and not limitation as other compositions and other percentage compositions fall clearly within the scope of the invention. The material may be added continually to the cooling system as with make-up water or intermittently as indicated.

We claim:

1. The method of inhibiting white rust corrosion of galvanized steel surfaces of recirculating evaporative water cooling systems operating with cooling water of alkaline pH comprising the step of adding to the cooling water a water soluble inhibitor composition containing one or more organophosphorus compounds selected from the group consisting of 1-hydroxyethylidene-1, 1-diphosphonic acid; aminotris methylenephosphonic acid; 2-phosphonobutane-1,2,4-tricarboxylic acid; 1,2-diaminocyclohexane tetrakis-(methylene-phosphonic acid); 2-methylpentane diamine tetrakis-(methylene-phosphonic acid); Phosphono-hydroxyacetic acid; one or more carbamate compounds selected from the group consisting of sodium dimethyldithiocarbamate and sodium diethyldithiocarbamate; and one or more water soluble alkali metal salts selected from the group consisting of alkali metal salts of molybdenum, titanium, tungsten and vanadium.

2. The method of claim 1 wherein said one or more water soluble alkali metal salts are selected from the group consisting of sodium molybdate dihydrate and sodium tungstate dihydrate.

3. The method of claim 2 wherein the inhibitor composition is added on a continuous basis.

4. The method of claim 3 wherein the inhibitor composition further comprises an amount of sodium hydroxide sufficient to adjust the pH of the composition to a pH value of at least 10.

5. The method of claim 4 wherein the inhibitor composition is added in the form of an aqueous solution.

6. The method of claim 4 wherein said inhibitor composition consists essentially of the following formula:

| Ingredient | Parts Active (by weight) |
|---|---|
| Sodium molybdate, dihydrate (as active Molybdenum) | 1 |
| 2-phosphonobutane-1,2,4-tricarboxylic acid | 2 |
| Phosphono-hydroxyacetic acid | 2 |
| Sodium diethyldithiocarbamate | 1 |
| Sodium hydroxide | As required to adjust pH to at least 10 |
| Water | Balance. |

7. The method of claim 4 wherein said inhibitor composition consists essentially of the following formula:

| Ingredient | Parts Active (by weight) |
|---|---|
| Sodium tungstate, dihydrate (as active Tungsten) | 2 |

-continued

| Ingredient | Parts Active (by weight) |
|---|---|
| 2-phosphonobutane-1,2,4-tricarboxylic acid | 2 |
| Phosphono-hydroxyacetic acid | 2 |
| Sodium diethyldithiocarbamate | 1 |
| Sodium hydroxide | As required to adjust pH to at least 10 |
| Water | Balance. |

8. The method of claim 7 further comprising the step of maintaining the concentration of said inhibitor composition in said cooling water at an effective corrosion inhibiting level up to about 500 mg/l.

9. The method of claim 1 wherein the inhibitor composition is added on a continuous basis.

10. The method of claim 1 wherein the inhibitor composition further comprises an amount of sodium hydroxide sufficient to adjust the pH of the composition to a pH value of at least 10.

11. The method of claim 10 wherein the inhibitor composition is added in a dried crystalline form.

12. The method of claim 1 wherein the inhibitor composition is added in the form of an aqueous solution.

13. The method of claim 1 further comprising the step of maintaining the concentration of said inhibitor composition in said cooling water at an effective corrosion inhibiting level up to approximately 500 mg/l.

14. A water soluble white rust inhibiting composition for treating water cooler systems by addition to cooling water contained consisting essentially of the following formula:

(a) an amount of one or more organophosphorus compound selected from the group consisting of 1-hydroxyethylidene-1, 1-diphosphonic acid; aminotris methylenephosphonic acid; 2-phosphonobutane-1,2,4-tricarboxylic acid; 1,2-diaminocyclohexane tetrakis-(methylene-phosphonic acid); 2-methylpentane diamine tetrakis-(methylene-phosphonic acid; Phosphono-hydroxyacetic acid;

(b) an amount of one or more carbamate compounds selected from the group consisting of sodium dimethyldithiocarbamate and sodium diethyldithiocarbamate; and (c) an amount of at least one water soluble alkali metal salt selected from the group consisting of alkali metal salts of Molybdenum; Titanium; Tungsten and Vanadium.

15. The additive composition of claim 14 wherein said alkali metal salt is selected from sodium molybdate dihydrate and sodium tungstate dihydrate.

16. The composition of claim 14 wherein the material is in a dried crystalline form.

17. The composition of claim 15 wherein said additive composition is in the form of an aqueous solution and including an amount of sodium hydroxide sufficient to adjust the pH to at least 10.

18. A water soluble white rust inhibiting composition for treating alkaline cooling water in evaporative water cooling systems by addition to the cooling water contained consisting essentially of the following formula:

| Ingredient | Parts Active (by weight) |
|---|---|
| Sodium molybdate, dihydrate (as active Molybdenum) | 1 |
| 2-phosphonobutane-1,2,4- | 2 |

-continued

| Ingredient | Parts Active (by weight) |
|---|---|
| tricarboxylic acid | |
| Phosphono-hydroxyacetic acid | 2 |
| Sodium diethyldithiocarbamate | 1 |
| Sodium hydroxide | Amount sufficient to adjust pH to a predetermined value |
| Water | Balance. |

19. The composition of claim 18 wherein the pH is adjusted to a value of at least 10.

20. A water soluble white rust inhibiting composition for treating evaporative water cooler systems by addition to cooling water contained therein comprising in combination the following formula:

| Ingredient | Parts Active (by weight) |
|---|---|
| Sodium tungstate, dihydrate (as active Tungsten) | 2 |
| 2-phosphonobutane-1,2,4-tricarboxylic acid | 2 |
| Phosphono-hydroxyacetic acid | 2 |
| Sodium diethyldithiocarbamate | 1 |
| Sodium hydroxide | Amount sufficient to adjust pH to a predetermined value |
| Water | Balance. |

21. The composition of claim 20 wherein the pH is adjusted to a value of at least 10.

* * * * *